US011054146B2

(12) United States Patent
Huang et al.

(10) Patent No.: US 11,054,146 B2
(45) Date of Patent: Jul. 6, 2021

(54) OVEN

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 74 days.

(21) Appl. No.: 16/254,844

(22) Filed: Jan. 23, 2019

(65) Prior Publication Data

US 2020/0232651 A1 Jul. 23, 2020

(51) Int. Cl.
*F24C 15/32* (2006.01)
*F24C 3/02* (2006.01)

(52) U.S. Cl.
CPC ..... *F24C 15/322* (2013.01); *F24C 3/022* (2013.01)

(58) Field of Classification Search
CPC .. F24F 5/0035; F24F 13/0263; F24F 13/0218; F24F 13/0209; F24F 13/0245; F24F 13/0281; F24F 13/30; F24F 1/0007; F24F 2203/10; F24F 12/001; F24F 12/006; F24F 13/0254; F24F 13/24;
(Continued)

(56) References Cited

U.S. PATENT DOCUMENTS 1,711,201 A * 4/1929 Hollman ..... F24C 15/32 126/39 A
3,313,917 A * 4/1967 Ditzler ..... F24C 15/325 219/400

(Continued)

FOREIGN PATENT DOCUMENTS

CN 2796593 Y 7/2006
CN 203634028 U 6/2014

(Continued)

OTHER PUBLICATIONS

Examination report for TW107144536, dated Dec. 9, 2019, Total of 5 pages.

(Continued)

*Primary Examiner* — Jason Lau
(74) *Attorney, Agent, or Firm* — Tracy M Heims; Apex Juris, pllc.

(57) ABSTRACT

The present invention provides an oven including an oven body with an exhaust port and a heat transfer assembly, disposed at a side of the oven body, that includes a top plate and a bottom plate connected by two side plates, and a sealing plate to form an air passage therebetween. The air passage has a first opening near the sealing plate and a second opening away from the sealing plate. The first opening communicates with the exhaust port of the oven body, and the second opening opens to the external of the heat transfer assembly which is arranged so the hot air from the exhaust port may enter the interior of the heat transfer assembly so that the heat energy of the hot air can be absorbed by the top plate and then conducted to the food materials on the top plate to be reused.

9 Claims, 13 Drawing Sheets

(58) Field of Classification Search
CPC ..... F24F 2006/143; F24F 2011/0002; F24F 2013/245; F24F 2221/125; F24F 2221/30; F24F 2221/34; F24F 2221/54; F24F 6/043; F24F 6/14; F24F 7/02; F24F 7/04; F28F 13/12; F28F 27/00; F28F 9/027; F28F 11/00; F28F 19/002; F28F 1/12; F28F 2275/00; F28F 27/003; F24C 15/006; F24C 15/325; F24C 15/32; F24D 2200/16; F24D 2220/042; F24D 2220/06; F24D 5/02; F24D 5/10
See application file for complete search history.

(56) References Cited

U.S. PATENT DOCUMENTS 5,045,333 A * 9/1991 Petrofsky ..... A21C 15/002 206/219
5,182,078 A * 1/1993 Baldi ..... B01J 25/00 414/9
2007/0089868 A1* 4/2007 Houfuku ..... F28F 1/40 165/133
2013/0125841 A1* 5/2013 Ichihara ..... F23J 15/06 122/420
2013/0174934 A1* 7/2013 Duffy ..... F16L 59/147 138/149
2014/0150775 A1* 6/2014 Noman ..... F24H 3/087 126/99 D
2018/0355548 A1* 12/2018 Oak ..... F26B 21/00

FOREIGN PATENT DOCUMENTS

| | | | | |
|---|---|---|---|---|
| CN | 108478033 A | | 9/2018 | |
| CN | 208016795 U | | 10/2018 | |
| CN | 108720645 A | | 11/2018 | |
| GB | 191514081 A | * | 6/1916 | ..... F24C 15/32 |
| TW | M563762 U | | 7/2018 | |
| WO | WO-2017097326 A1 | * | 6/2017 | ..... F24C 15/32 |

OTHER PUBLICATIONS

Search report for TW107144536, dated Dec. 9, 2019, Total of 1 page.
English abstract for CN108478033, Total of 1 page.
English abstract for CN203634028, Total of 1 page.
English abstract for CN2796593, Total of 1 page.
English abstract for CN108720645, Total of 1 page.
English abstract for CN208016795, Total of 1 page.
English abstract for TWM563762, Total of 1 page.
Search report for CN201811541812.1, Total of 2 pages.

* cited by examiner

OVEN

BACKGROUND OF THE INVENTION

Technical Field

The present invention is related to a baking equipment and, more particularly, to an oven that can fully utilize the heat of exhausted gas.

Description of Related Art

It is well known that the heating device for cooking food, such as a stove, an oven, a roaster, or a griller, usually discharges the high temperature hot air generated during operation to the external of the heating device directly, which causes the temperature of the surrounding environment to rise. For the personnel working in the high temperature environment, the hot atmosphere not only causes physical discomfort, but also leads to heat stroke if drinking water isn't replenished timely. In severe cases, it may even cause heat exhaustion and shock. In addition to the heath loss mentioned above, the personnel may suffer more direct injury, such as scald or burn, if they accidentally touch hot air.

In addition, the cooked food will cool easily after leaving the heating device and before being served on the table due to the lack of continuous heating. In order to serve the hot food, the cooled food must be heated by the heating device again. Such repeated heating not only destroys the deliciousness of the food, but also wastes the energy for heating. If the cooked food must be stored in the heat preservation device to avoid cooling, additional purchase of the heat preservation device is required, resulting in increase of the cost and energy consumption.

Furthermore, the frozen food needs to undergo a thawing step before being cooked in the heating device so as not to consume excessive energy during cooking. Generally, the thawing step either places the frozen food in the ambient environment or in the water, which takes time and affects the serving of subsequent meals.

Therefore, how to improve the above issues and lack, such as energy consumption, time consuming, and exposing the personnel to dangers, is the problem to be solved.

BRIEF SUMMARY OF THE INVENTION

In view of the above, the purpose of the present invention is to provide an oven which can reuse the heat energy of the hot air generated by the food heated in the oven to heat other food before the hot air is discharged.

The present invention provides an oven including an oven body and a heat transfer assembly. The oven body has an exhaust port. The heat transfer assembly is disposed at a side of the oven body and includes a top plate, a bottom plate, two side plates, and a sealing plate. The top plate and the bottom plate are connected by the two side plates and the sealing plate to form a guiding duct, in which an air passage surrounded by the top plate, the bottom plate, the two side plates, and the sealing plate are defined. The air passage has a first opening near the sealing plate and a second opening away from the sealing plate. In particular, the first opening communicates with the exhaust port of the oven body, and the second opening opens to the external of the heat transfer assembly.

The advantage of the present invention is that the heat energy of the hot air generated in the oven body can be transmitted to the top plate of the heat transfer assembly for heating or thawing the food placed on the top plate after the hot air leaves the oven body and enters the airflow passage, which effectively utilizes the heat energy of the hot air and lower the temperature of the hot air in order to prevent the personnel around the oven from being burned and avoid the uncomfortably hot working environment around the oven.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
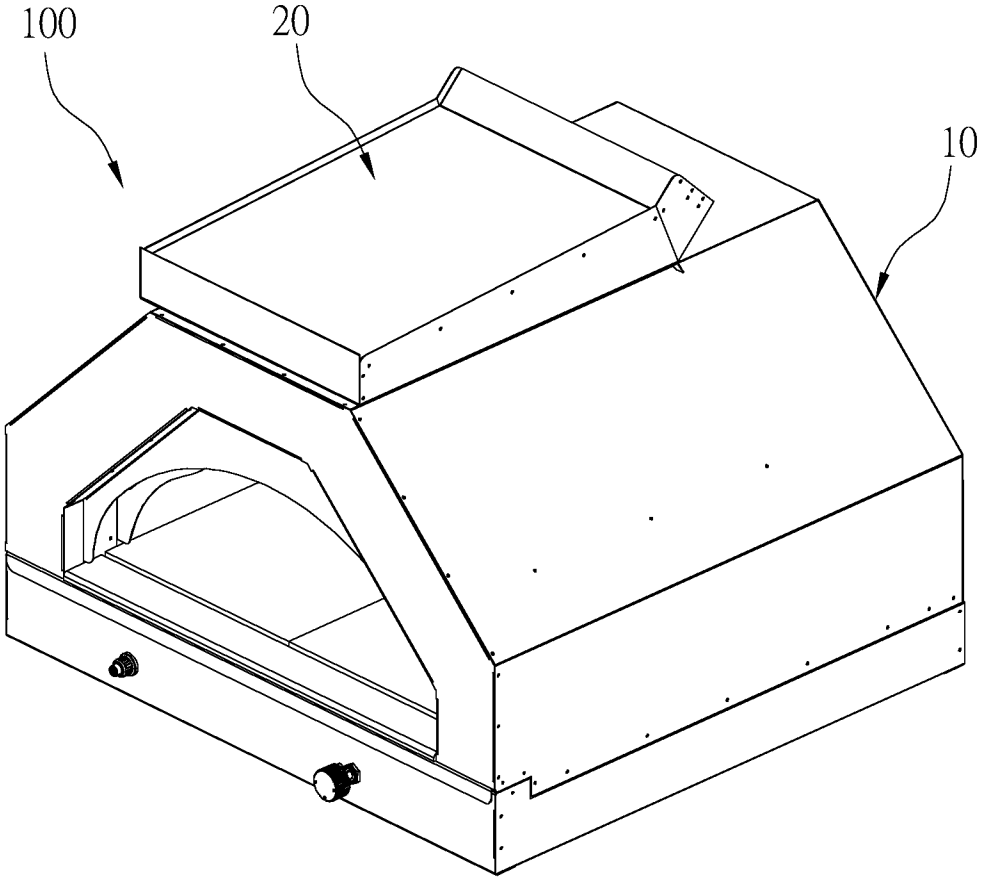
FIG. 1 is a perspective view of an oven according to a first embodiment of the present invention.
Figure 2:
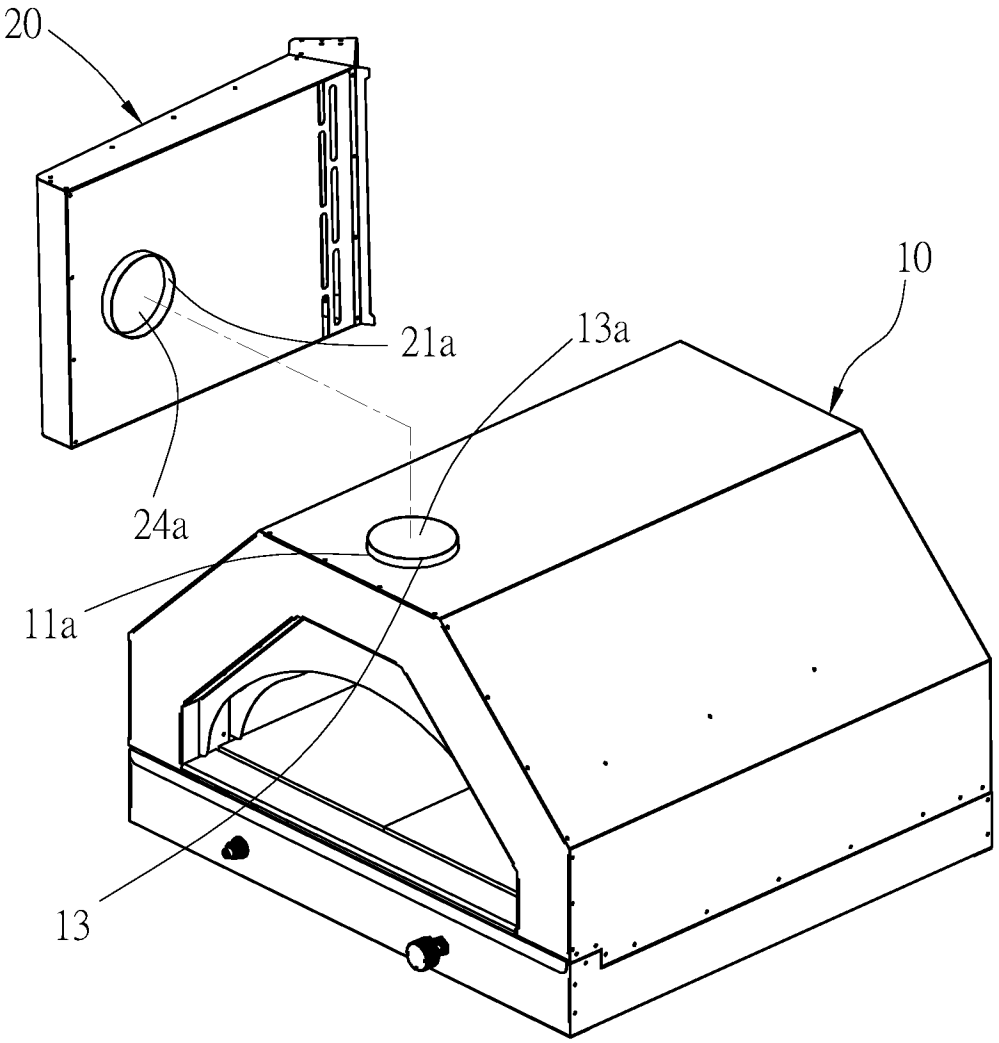
FIG. 2 is a schematic view showing the disassembled oven body and heat transfer assembly of the oven of FIG. 1.
Figure 3:
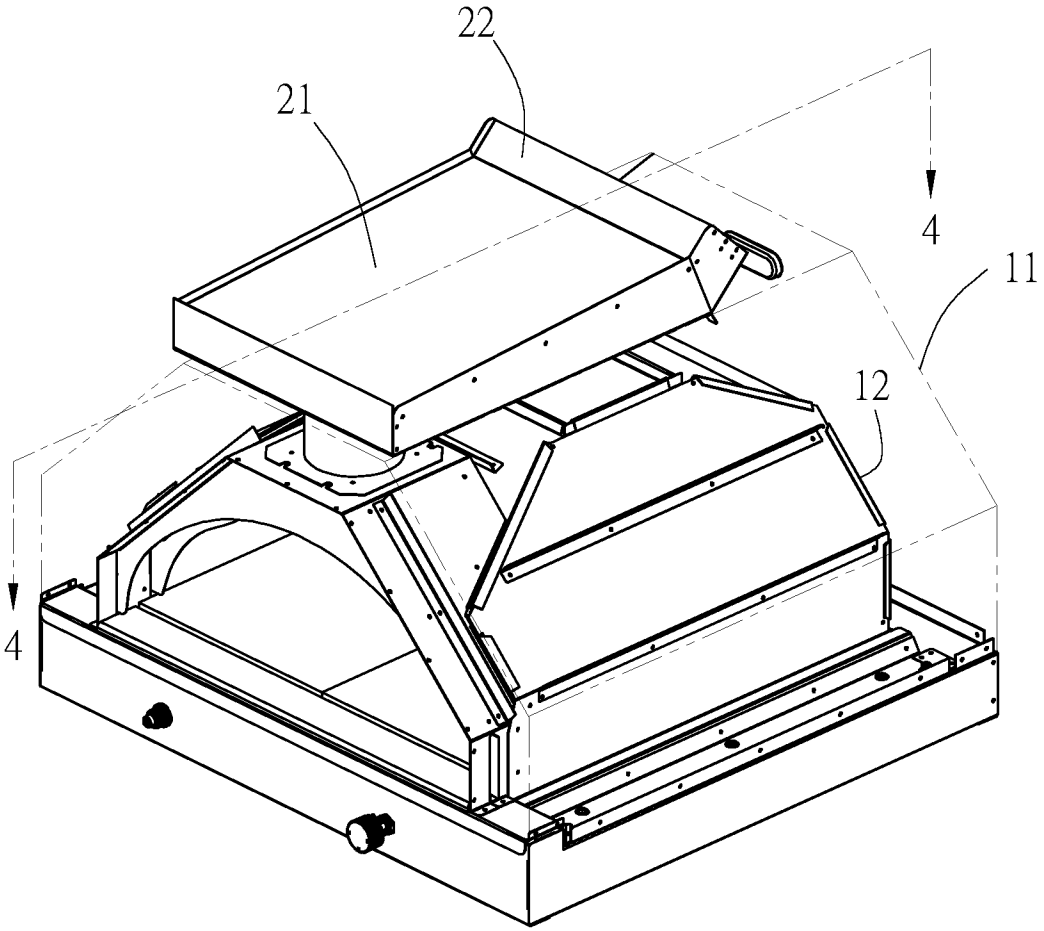
FIG. 3 is a partial transparent view of the oven body in FIG. 1.
Figure 4:
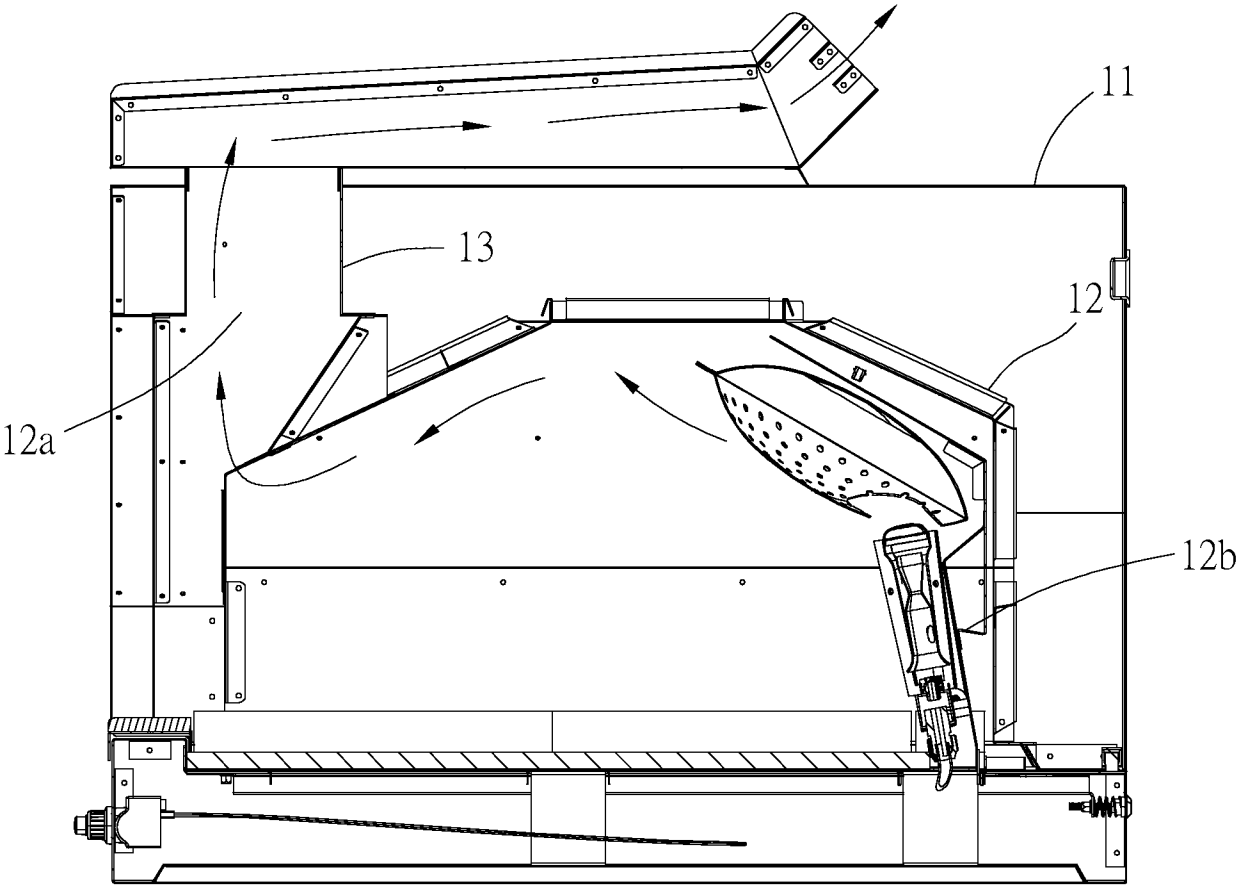
FIG. 4 is a cross-sectional view taken along line 4-4 in FIG. 3.

An oven 100 according to a first embodiment of the present invention is shown in FIG. 1 to FIG. 7 The oven 100 includes an oven body 10 and a heat transfer assembly 20. The oven body 10 has a casing 11, a main body 12 and an exhaust pipe 13. An opening 11*a* is formed on the top of the casing 11, and an opening 12*a* is formed on the top of the main body 12. A heat source (not shown) is provided in the main body 12 for heating. One end of the exhaust pipe 13 is connected to the opening 12*a* of the main body 12, and the other end of the exhaust pipe 13 is partially exposed to the external of the casing 11 through the opening 11*a* of the casing 11. Further, a heating device 12*b* is provided inside the main body 12, and the hot air generated by the heating device 12*b* turbulently flows upward along the exhaust pipe 13. In addition, an inlet is provided at the front side of the oven body 10 to communicate with the interior of the main body 12.

The heat transfer assembly 20 includes a guiding duct 21, an extension duct 22, and at least one partition 23. The guiding duct 21 is fabricated from a top plate 211, a bottom plate 212, two side plates 213, and a sealing plate 214 to form an air passage 24 inside.

Figure 5:
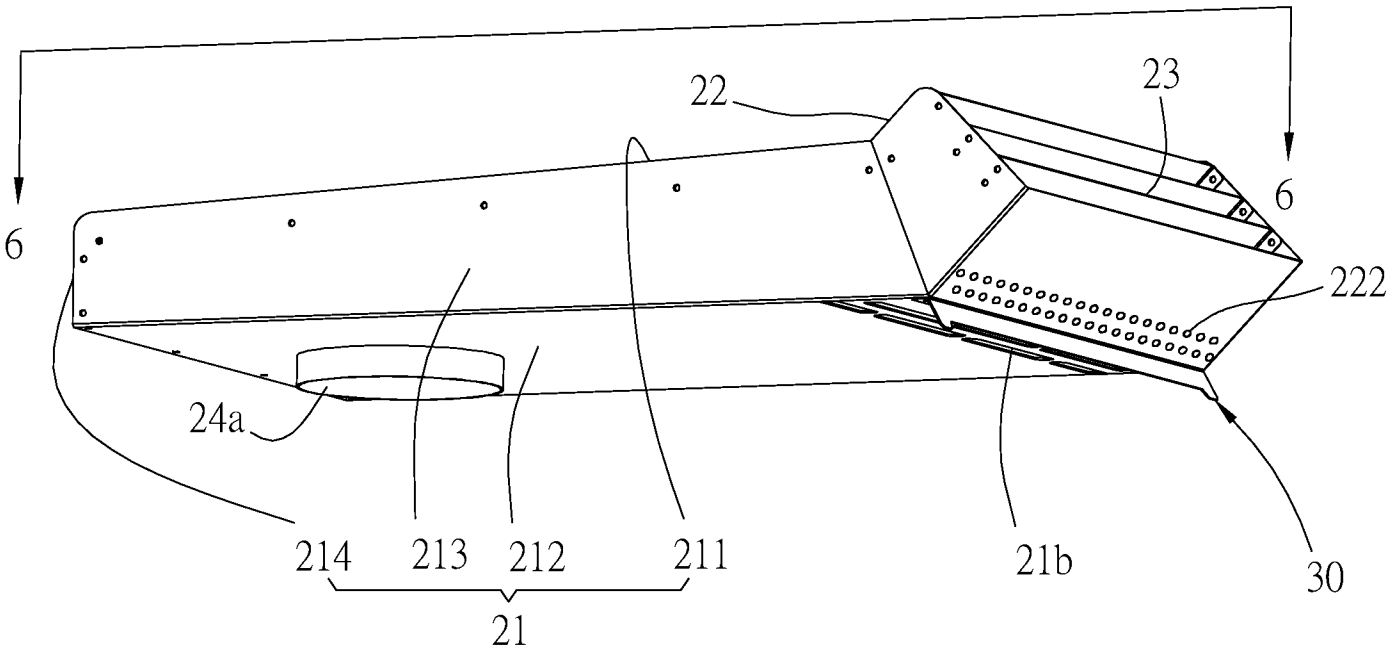
FIG. 5 is a perspective view of the heat transfer assembly according to the first embodiment of the present invention.

The top plate 211 and the bottom plate 212 are connected through the two side plates 213 and the sealing plate 214. One end of the top plate 211 connecting the sealing plate 214 is closer to the bottom plate 212 than the other end of the top plate 211 away from the sealing plate 214 such that the top plate 211 is arranged in a tilted manner A first opening 24*a* and a second opening 24*b* are respectively provided at two ends of the air passage 24. The first opening 24*a* is located at the bottom plate 212 and adjacent to the sealing plate 214. The second opening 24*b* is away from the sealing plate 214 and surrounded by the top plate 211, the bottom plate 212 and the two side plates 213 to communicate with the interior of the extension duct 22. The extension duct 22 has a first duct opening 22*a* and a second duct opening 22*b*. The first duct opening 22*a* communicates with the second opening 24*b* of the guiding duct 21, and the second duct opening 22*b* communicates with the exterior of the heat transfer assembly 20 and faces the rear side of the oven body 10. In the present embodiment, there are two partitions 23, both of which span the interior of the extension duct 22 to be mounted on the inner wall surface of the extension duct 22 and located near the second duct opening 22*b* and away from the second opening 24*b*, but the number of the partition 23 is not limited thereto and may be only one or none. In addition, the extension duct 22 is also provided with a plurality of perforations 222 (as shown in FIG. 5) near the guiding duct. The perforations face downward and communicate with the interior and exterior of the extension duct 22.

Figure 6:
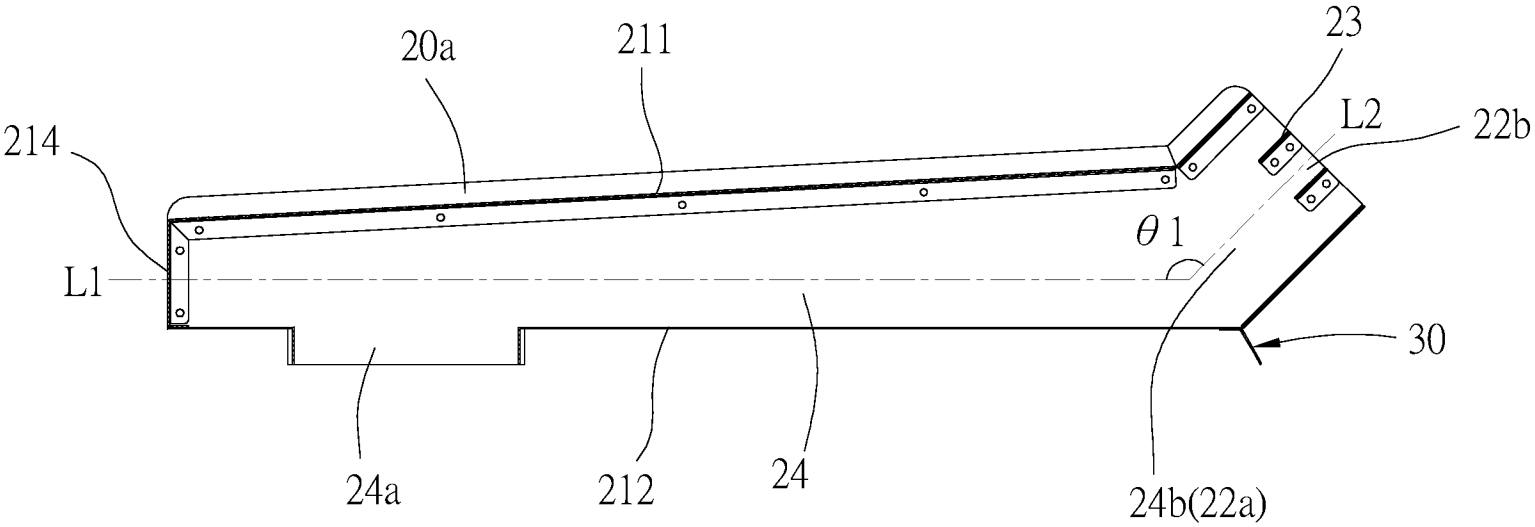
FIG. 6 is a cross-sectional view taken along line 6-6 in FIG. 5.
Figure 7:
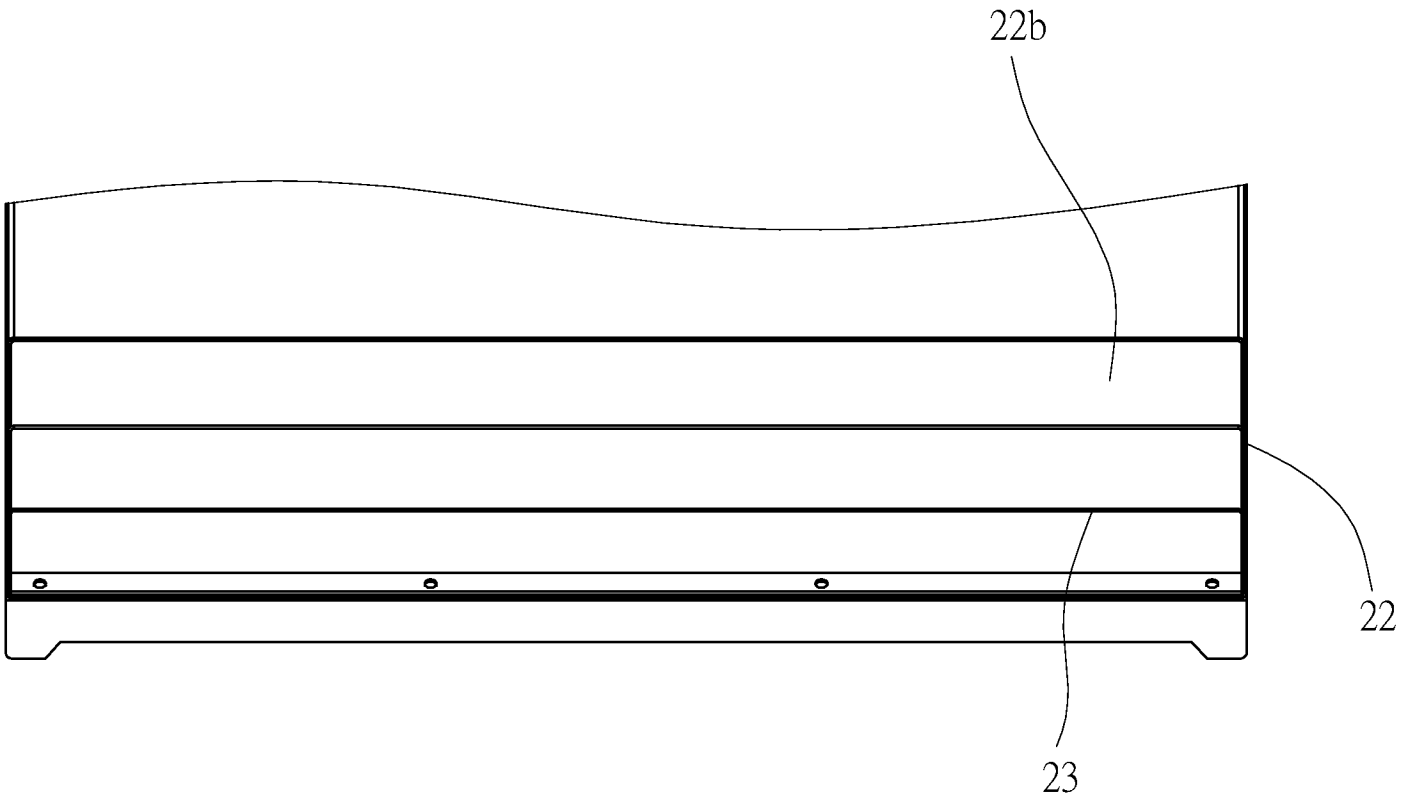
FIG. 7 is a side view of the extension duct in FIG. 6.

As shown in FIG. 6, the guiding duct 21 has a first axis L1 extending along its longitudinal direction, and the extension duct 22 has a second axis L2 extending along its longitudinal direction. A first angle θ1 is formed between the first axis L1 and the second axis L2 such that the second duct opening 22*b* of the extension duct 22 faces upward. In the present embodiment, the extension duct 22 is configured such that it faces outward and upward.

The heat transfer assembly 20 is mounted on the casing 11 of the oven body 10. To improve the stability after the assembling, the heat transfer assembly 20 is provided with a tube sleeve 21*a* around the first opening 24*a*. The tube sleeve 21*a* and the portion of the exhaust pipe 13 not covered by the casing 11 are sleeved to each other to obtain a stable connection structure, and simultaneously the exhaust port 13*a* can be communicated with the first opening 24*a*. In addition, a bracket 30 is provided on the other side opposite to the side where the tube sleeve 21*a* and the exhaust pipe 13 are connected to elevate the bottom plate such that the bottom plate is substantially parallel to the oven body, which facilitates the balance of the height of the heat transfer assembly 20 and improvement of the stability after assembling.

Since the second duct opening 22*b* is designed to face upward, substances such as rainwater or falling dust easily enter the interior of the heat transfer assembly 20 via the second duct opening 22*b*. Therefore, in this embodiment, a plurality of outlets 21*b* is provided on the bottom plate 212. The outlets 21*b* are provided near the second duct opening 22*b* and opens to the external of the heat transfer assembly so that foreign substances or water entering via the second duct opening 22*b* can leave the interior of the guiding duct 21, or the water condensed in the guiding duct 21 can flow out through the outlets 21*b* to maintain the cleanness inside the heat transfer assembly 20. The shape of the outlet 21*b* is not limited to an elongated shape, and may be a circular shape, and the number of the outlet 21*b* may be at least one. Foreign substances or water entering via the second duct opening 22*b* may also leave the extension duct 22 through the perforations 222.

By the arrangement of the heat transfer assembly 20 described above, the hot air generated by the heating device 12*b* may turbulently flow up along the exhaust pipe 13, and then enters the guiding duct 21 through the first opening 24*a*. The inclined top plate 211 allows the hot air to smoothly move to the second opening 24*b* in accordance with the physical characteristics (hot air being easy to rise), then enters the interior of the extension duct 22 through the first duct opening 22*a*, and finally leaves the heat transfer assembly 20 via the second duct opening 22*b*. Also, the hot air can be dispersed by the partition 23 when leaving the extension duct 22.

The top plate 211 of the heat transfer assembly 20 of the present embodiment is made of a material having good thermal conductivity, and thus the heat energy of the hot air flowing through the air passage 24 can be conducted to the outer surface of the top plate 211. For the food or food materials placed on the outer surface of the top plate 211, the heat preservation or thawing effect can be obtained by absorbing the heat energy conducted by the top plate 211.

In addition, in the present embodiment, the top edges of the two side plates 213 and the sealing plate 214 are higher than the outer surface of the top plate 211 so that a receiving trough 20*a* surrounded by the protruding portions of the side plates 213 and the sealing plate 214 is formed on the outer surface of the top plate 211 for receiving food or food materials. Thus, the food or food materials placed on the top plate 211 will not slip off the top plate 211 even though the top plate 211 is inclined. It is worth mentioning that the food or food materials are placed on the top plate 211 instead of in the air passage 24, so that the hot air discharged from the exhaust port 13*a* is not in direct contact with the food or food materials to prevent the food or food materials from being contaminated by the discharged hot air to become odorous.

Other embodiments that can achieve the same effect of heat preservation or thawing on the food or food materials as the above embodiment will be described below. Since the structure of the oven body 10 is unchanged, the following description only focuses on the different structural types of the heat transfer assembly.

Figure 8:
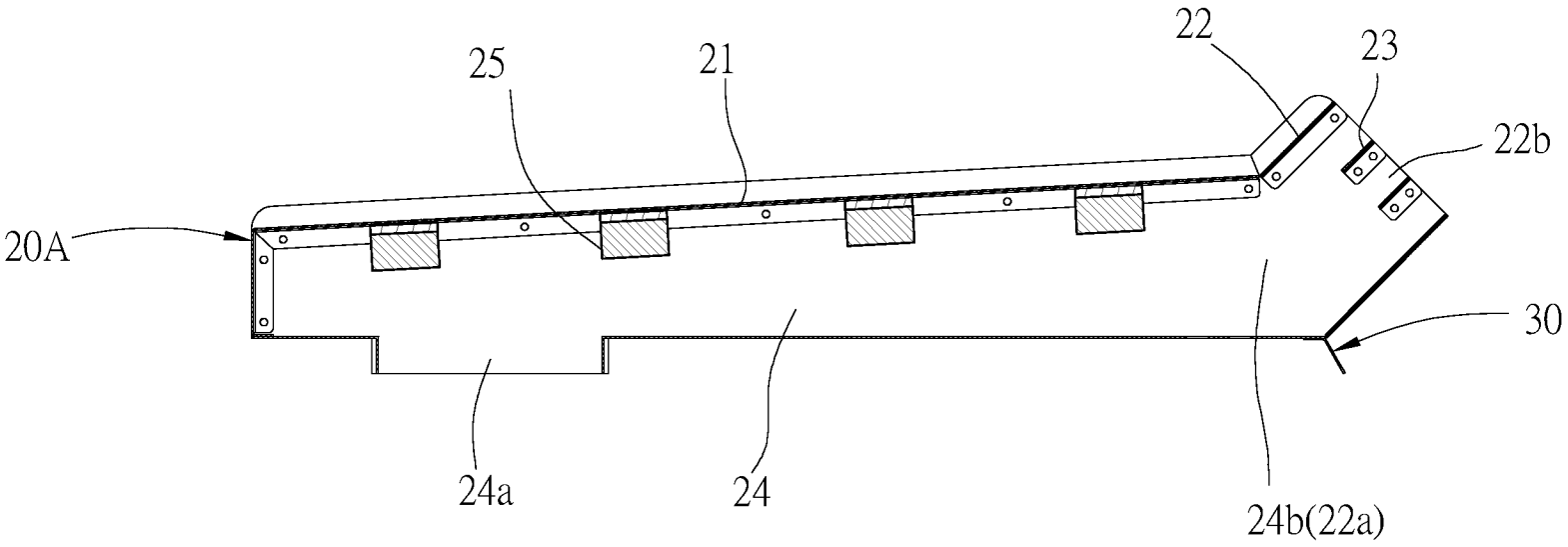
FIG. 8 is a schematic view of a heat transfer assembly according to a second embodiment of the present invention.
Figure 9:
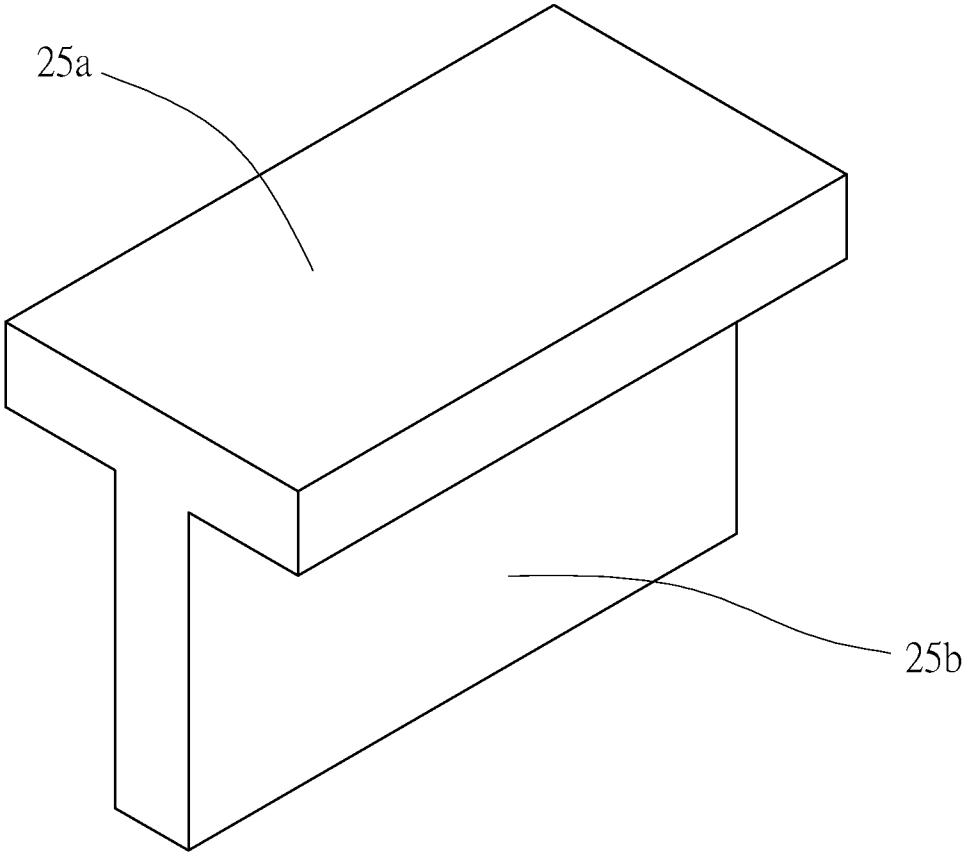
FIG. 9 is a perspective view of the heat conducting member in FIG. 8.

Referring to FIG. 8 and FIG. 9, a heat transfer assembly 20A according to a second embodiment of the present invention is shown, which has the same components as the heat transfer assembly 20 of the first embodiment described above, except that a plurality of heat conducting members 25 is additionally provided. The heat conducting members 25 are distributed along the flow direction of the hot air flowing through the air passage. Each of the heat conducting members 25 includes a heat conducting portion 25*a* and a heat absorbing portion 25*b*. The heat conducting portion 25*a* is coupled to an inner surface of the top plate 211, and the heat absorbing portion 25*b* is connected to the heat conducting portion 25*a* and extends downward. The heat absorbing portion 25*b* is in contact with the hot air in the air passage 24 and transmits the heat energy from the hot air to the top plate 211 through the heat conducting portion 25*a*, so that the heat energy of the hot air in the air passage 24 can be absorbed and used effectively.

Figure 10:
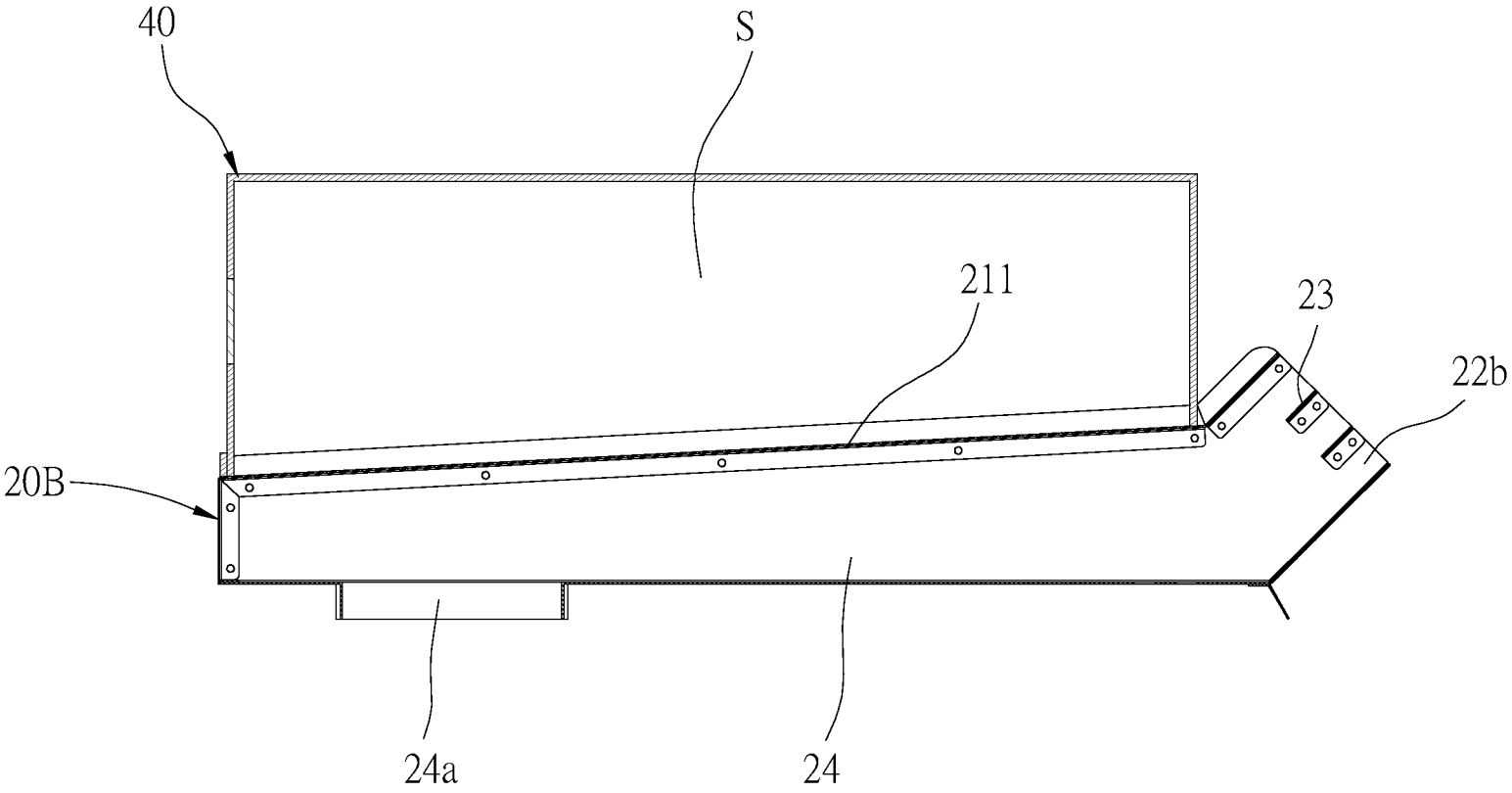
FIG. 10 is a schematic view of a heat transfer assembly according to a third embodiment of the present invention.

FIG. 10 shows a heat transfer assembly 20B according to a third embodiment of the present invention, which has the same components as the heat transfer assembly 20 of the first embodiment, except that a thermal insulating cover 40 is further provided on the top plate 211 of the heat transfer assembly 20B of the present embodiment to form a heat preserving space S between the thermal insulating cover 40 and the top plate 211 for receiving the food or food materials therein. The thermal insulating cover 40 can not only prevent dust and the like from falling on the food or food materials placed on the top plate 211, but also make the heat energy in the heat preserving space S difficult to dissipate.

Figure 11:
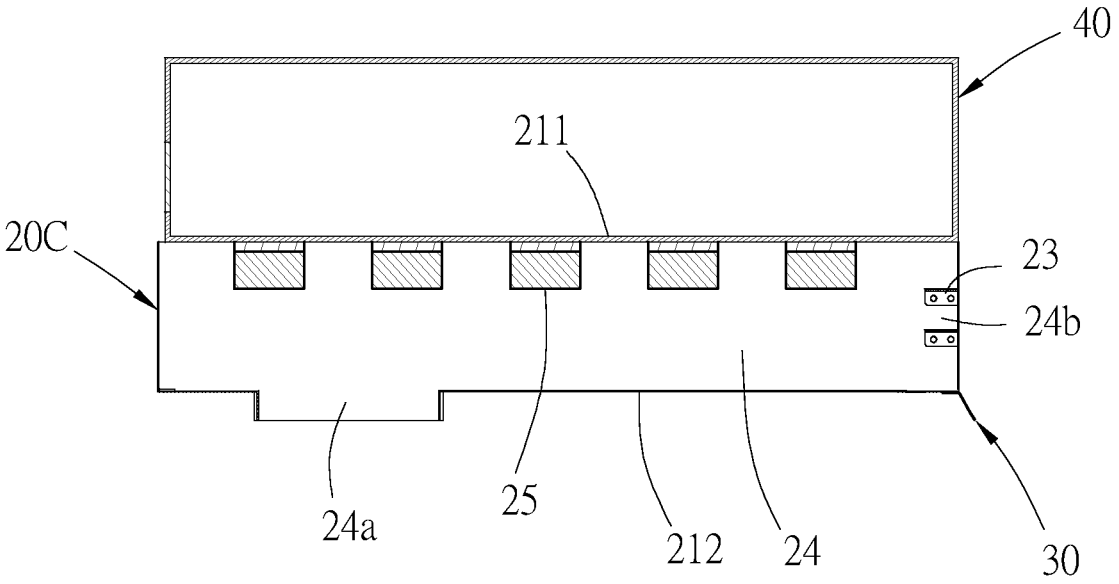
FIG. 11 is a schematic view of a heat transfer assembly according to a fourth embodiment of the present invention.

FIG. 11 shows a heat transfer assembly 20C according to a fourth embodiment of the present invention. The heat transfer assembly 20C includes a top plate 211, a bottom plate 212, two side plates 213, a sealing plate 214, two partitions 24, a bracket 30, a heat conducting member 25, and a thermal insulating cover 40, which have the same connection relationships and functions as those described in the first to the third embodiments, and therefore will not be described again. It should be noted that the top plate 211 of the heat transfer assembly 20C of the present embodiment is disposed in parallel with the bottom plate 212, and the partitions 23 are disposed between the two side plates 213 and adjacent to the second opening 24*b*. The bottom plate 212 of the present embodiment is not provided with the outlet 21*b*, but the outlet may be provided in other applications (not shown).

Figure 12:
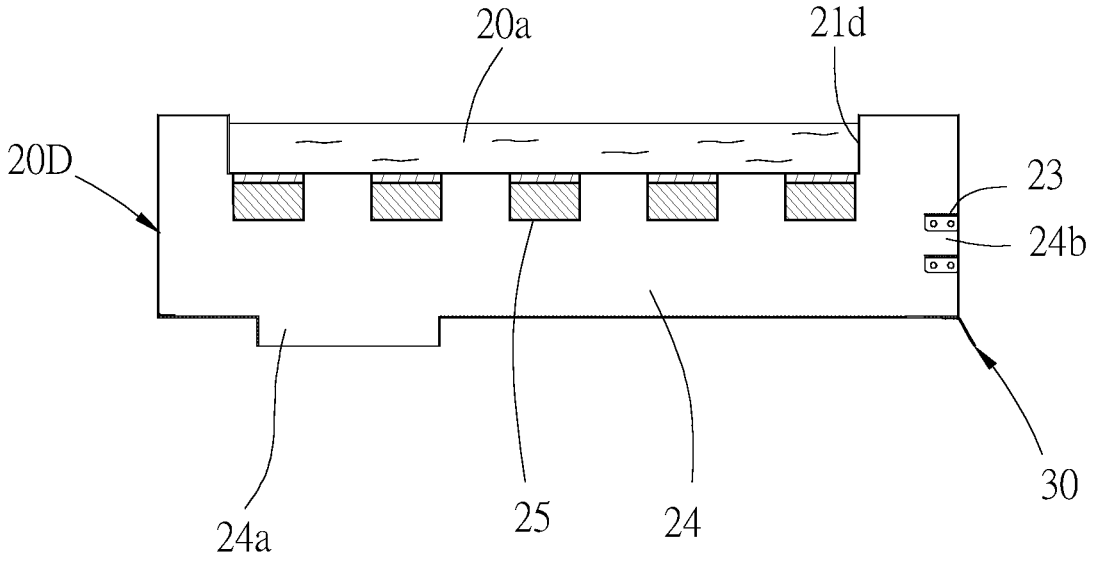
FIG. 12 is a schematic view of a heat transfer assembly according to a fifth embodiment of the present invention.

FIG. 12 shows a heat transfer assembly 20D according to a fifth embodiment of the present invention, which has substantially the same components as that of the fourth embodiment, except that the thermal insulating cover 40 is not provided, and one end of the top plate 211 adjacent to the second opening 24*b* is provide with a protrusion 21*d* so that the top edges of the two side plates 213 and the sealing plate 214 as well as the protrusion 21*d* surround to form the receiving trough 20*a* on the outer surface of the top plate 211. The user can pour water (having larger specific heat and thus better heat preservation efficacy) into the receiving trough 20*a* and then put the food to be thawed in the water, or add a shelf (not shown) in the water to support the food for preventing the food from getting wet.

Figure 13:
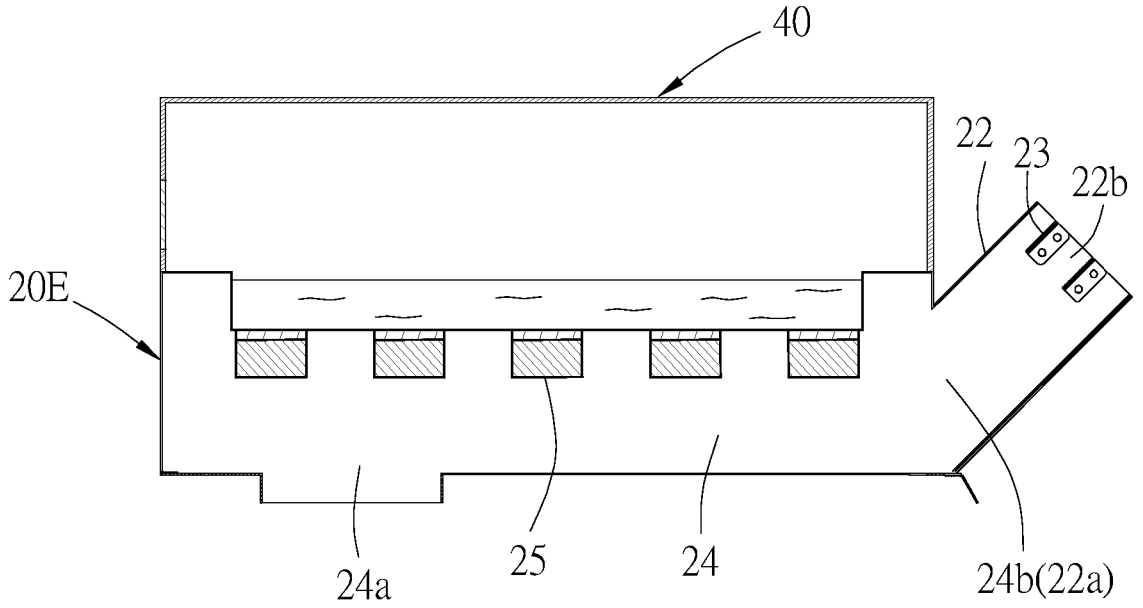
FIG. 13 is a schematic view of a heat transfer assembly according to a sixth embodiment of the present invention.

FIG. 13 is a heat transfer assembly 20E according to a sixth embodiment of the present invention. This embodiment discloses an aspect that combines the fourth embodiment with the fifth embodiment. The components of the present embodiment have the same construction and efficacy as those described above and will not be described again. It is to be noted that the present embodiment further includes the extension duct 22 of the first embodiment. The connection manner of the extension duct 22 and the direction of the second duct opening 22*b* are also the same as those described in the first embodiment, and the two partitions 23 are also spanned the interior of the extension duct 22 and fixed on the inner wall surface.

Figure 14:
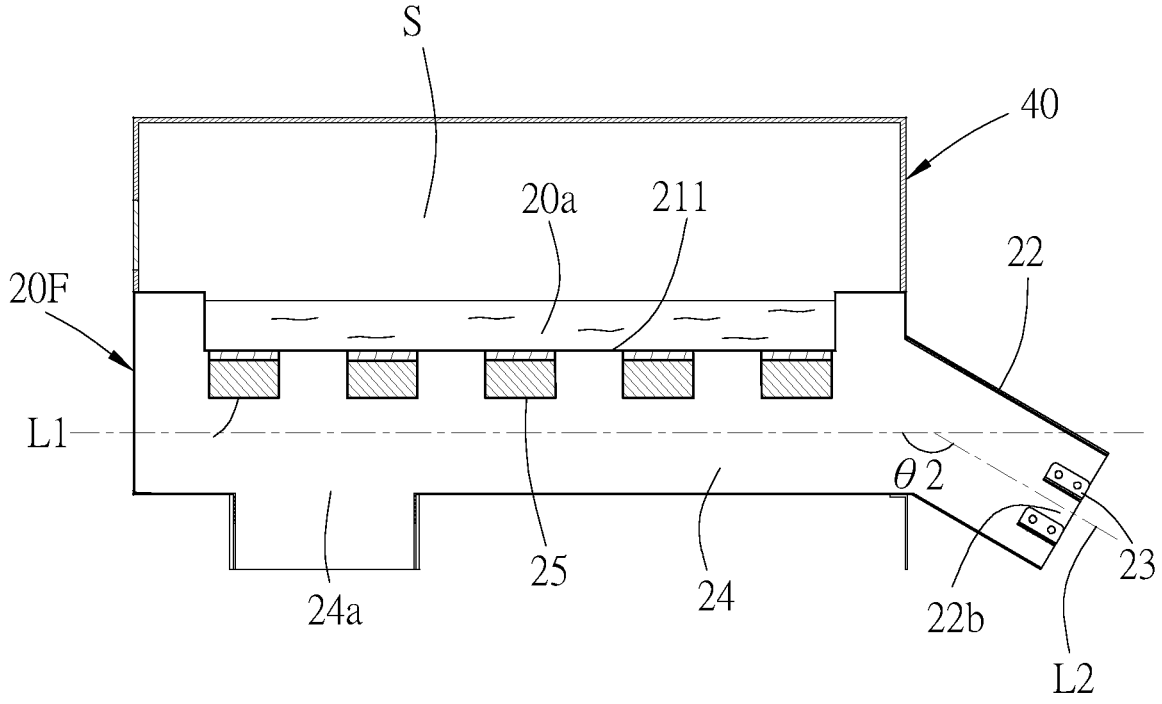
FIG. 14 is a schematic view of a heat transfer assembly according to a seventh embodiment of the present invention.

FIG. 14 is a heat transfer assembly 20F according to the seventh embodiment of the present invention. This embodiment has substantially the same configuration as that of the sixth embodiment. It should be noted that the axes L1 and L2 of the guiding duct 21 and the extension duct 22 in this embodiment are crossed to form a second angle θ2 so that the second duct opening 22*b* of the extension duct 22 faces downward. The bottom plate 212 is not provided with the outlet 21*b*. The rising hot air is confined by the downward design of the second duct opening 22*b*, thereby prolonging the time the hot air stays in the air passage 24, so that the heat energy of the hot air is transmitted to the top plate 211 easily and utilized effectively.

Figure 15:
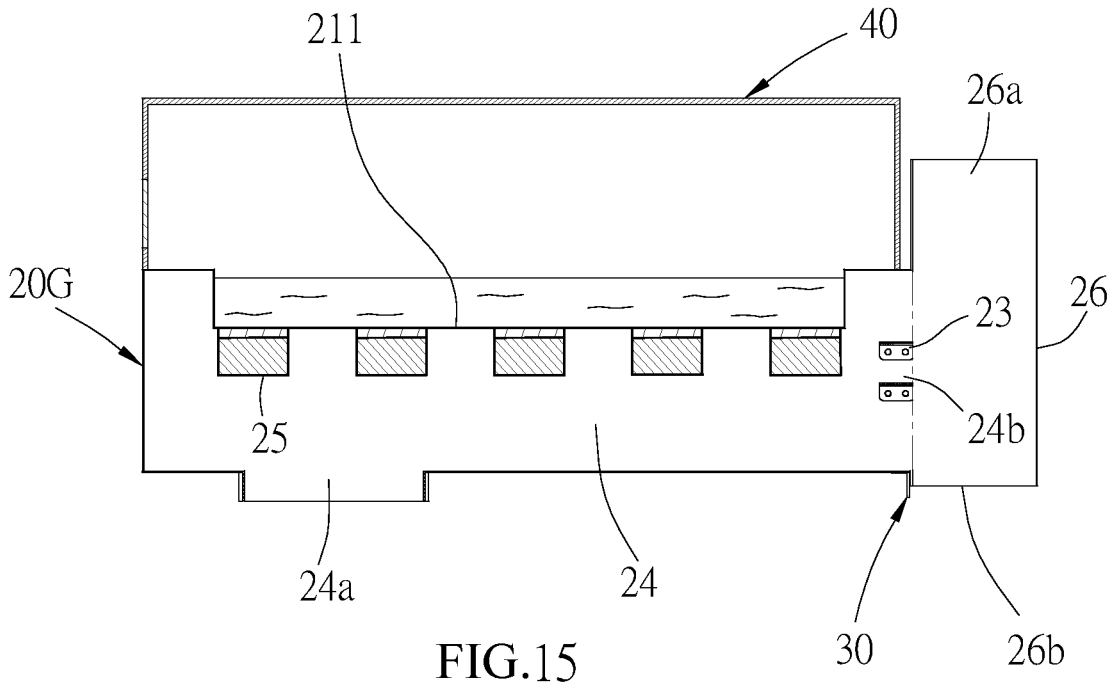
FIG. 15 is a schematic view of a heat transfer assembly according to an eighth embodiment of the present invention.

FIG. 15 is a heat transfer assembly 20G according to the eighth embodiment of the present invention. Based on the fifth embodiment, the present embodiment further has the heat insulation cover 40 of the fourth embodiment on the top plate 211 and an additional vertical pipe 26 at the side of the protrusion 21*d*. The vertical pipe 26 has an upper opening 26*a* and a lower opening 26*b* in communication with each other. A portion of the vertical pipe 26 between the upper opening 26*a* and the lower opening 26*b* communicates with the second opening 24*b*. By the design of the vertical pipe 26, the rainwater or dust falling into the upper opening 26*a* can be prevented from entering the air passage 24.

Figure 16:
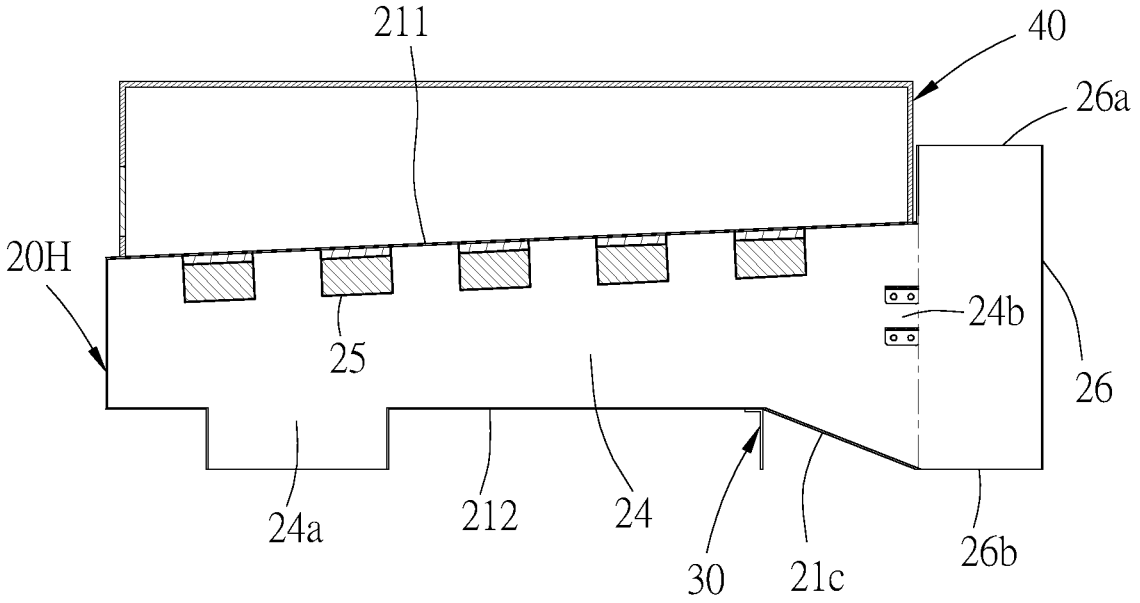
FIG. 16 is a schematic view of a heat transfer assembly according to a ninth embodiment of the present invention.

Referring to FIG. 16, a heat transfer assembly 20H according to a ninth embodiment of the present invention has substantially the same components and functions as those described in the eighth embodiment, except that the top plate 211 of the present embodiment is configured in an inclined manner as the first embodiment, so the receiving trough 20*a* does not store water. The bottom plate 212 has an inclined section 21*c* adjacent to the vertical pipe 26. One end of the inclined sections 21*c* is connected to the vertical pipe 26 and the other end of the inclined section 21*c* is provided with a bracket 30. The inclined section 21*c* allows the dirty substances, such as rainwater or dust falling via the upper opening 26*a* and entering the air passage 24 inadvertently, to roll out of the air passage 24 and leave through the lower opening 26*b* due to the inclined design.

By the design of the heat transfer assemblies 20 to 20H of the first to ninth embodiments described above, the heat energy of the hot air entering the air passage 24 can be recovered and reused, and the temperature of the hot air can be reduced when discharged into the atmosphere, which eliminates the inconvenience caused by the hot working environment. It is worth mentioning that the separation of food or food materials from the air passage effectively avoids the deterioration of the delicious smell of food or food materials.

It must be pointed out that the embodiments described above are only some embodiments of the present invention. All equivalent structures which employ the concepts disclosed in this specification and the appended claims should fall within the scope of the present invention.

What is claimed is:

1. An oven comprising:

an oven body having an exhaust port; and a heat transfer assembly disposed at a side of the oven body and including a top plate, a bottom plate, two side plates, and a sealing plate, wherein the top plate and the bottom plate are connected by the two side plates and the sealing plate to form a guiding duct, in which an air passage surrounded by the top plate, the bottom plate, the two side plates, and the sealing plate are defined; and the air passage has a first opening near the sealing plate and a second opening away from the sealing plate, wherein the first opening communicates with the exhaust port of the oven body and the second opening opens to the external of the heat transfer assembly;

wherein the side plates and the sealing plate extend from the bottom plate straight upward to contain top edges which are higher than the outer surface of the top plate, a receiving trough surrounded by protruding portions of the side plates and the sealing plate is formed on the outer surface of the top plate and is adapted to receive an object;

the top plate of the heat transfer assembly ducts the heat energy of a hot air generated by the oven body and flowing through the air passage to an outer surface of the top plate and to the object;

wherein the side plates and the sealing plate do not overlap with the the outer surface of the top plate, wherein the top plate is arranged in a tilted manner such that one end of the top plate connecting the sealing plate is closer to the bottom plate than the other end of the top plate away from the sealing plate, wherein the heat transfer assembly further comprises an extension duct communicating with the guiding duct through the second opening, the guiding duct has a first axis extending along its longitudinal direction, the extension duct has a second axis extending along its longitudinal direction, and an angle is formed between the first axis and the second axis, wherein the heat transfer assembly further comprises at least one partition in the extension duct away from the second opening, and wherein the bottom plate has at least one outlet adjacent to the second opening and opening to the external of the heat transfer assembly.

2. The oven according to claim 1, further comprising a thermal insulating cover mounted on the top plate to form a heat preserving space between the thermal insulating cover and the top plate.

3. The oven according to claim 1, wherein the heat transfer assembly includes a plurality of heat conducting members, each of which has a heat conducting portion coupled to an inner surface of the top plate and a heat absorbing portion connected to the heat conducting portion for contacting the hot air in the air passage.

4. The oven according to claim 3, wherein the heat conducting members are distributed along a flow direction of the hot air flowing through the air passage.

5. The oven according to claim 1, wherein the heat transfer assembly is disposed above the oven body, and the first opening is in communication with the exhaust port through at least one tube sleeve.

6. The oven according to claim 1, further comprising a bracket adapted to elevate the bottom plate such that the bottom plate is substantially parallel to the oven body.

7. The oven according to claim 1, further comprising a vertical pipe adjacent to the heat transfer assembly, wherein the vertical pipe has an upper opening and a lower opening, between which a portion of the vertical pipe communicates with the second opening.

8. The oven according to claim 1, wherein the extension duct is provided with a plurality of perforations near the guiding duct.

9. The oven according to claim 1, further comprising at least one partition mounted between the two side plates and adjacent to the second opening.

* * * * *